United States Patent [19]

Takasaki

[11] Patent Number: 4,547,008

[45] Date of Patent: Oct. 15, 1985

[54] LOCK FOR REFRIGERATOR OR THE LIKE WHICH CAN BE UNLOCKED FROM INSIDE THEREOF

[75] Inventor: Kunuhiko Takasaki, Chiba, Japan

[73] Assignee: Takigen Seizou Co., Ltd., Tokyo, Japan

[21] Appl. No.: 582,431

[22] Filed: Feb. 22, 1984

[30] Foreign Application Priority Data

Feb. 28, 1983 [JP] Japan ..... 58-28305[U]

[51] Int. Cl.[4] ..... E05C 15/02

[52] U.S. Cl. ..... 292/341.15

[58] Field of Search ..... 292/341.15, 341.17, 292/341.18, 341.19, DIG. 65, DIG. 71

[56] References Cited

U.S. PATENT DOCUMENTS

| | | | |
|---|---|---|---|
| 2,166,735 | 7/1939 | Sword | 292/341.17 X |
| 2,762,645 | 9/1956 | Bordner, Jr. | 292/341.17 |
| 3,936,086 | 2/1976 | Berkowitz | 292/341.17 |

*Primary Examiner*—Richard E. Moore

*Attorney, Agent, or Firm*—Martin Smolowitz

[57] ABSTRACT

A lock for a refrigerator or the like which can be unlocked from the inside thereof comprises a handle unit mounted on a door and a keeper mounted on a body frame wall of the refrigerator or the like. The keeper is constituted by a fixed seat and a movable body having its outer proximal end pivotally attached to the outer end of the fixed seat. A follower pin provided at an intermediate portion of a lock shaft is slidably urged by a spring toward the fixed seat inner end so as to abut on an inclined cam surface formed on the outer end surface of the fixed seat inner end. An actuating lever pivotally attached to the outer end of the fixed seat is rotated with a push rod, inside the refrigerator or the like, which is inserted through a guide hole in the center of the fixed seat so that the follower pin is pushed by the inner end of the actuating lever to cause the lock shaft to slide outwardly while rotating, to permit the lock shaft to escape from a bearing hole in the movable body, thereby allowing the movable body to be rotatable with respect to the fixed seat.

6 Claims, 21 Drawing Figures

FIG. 5
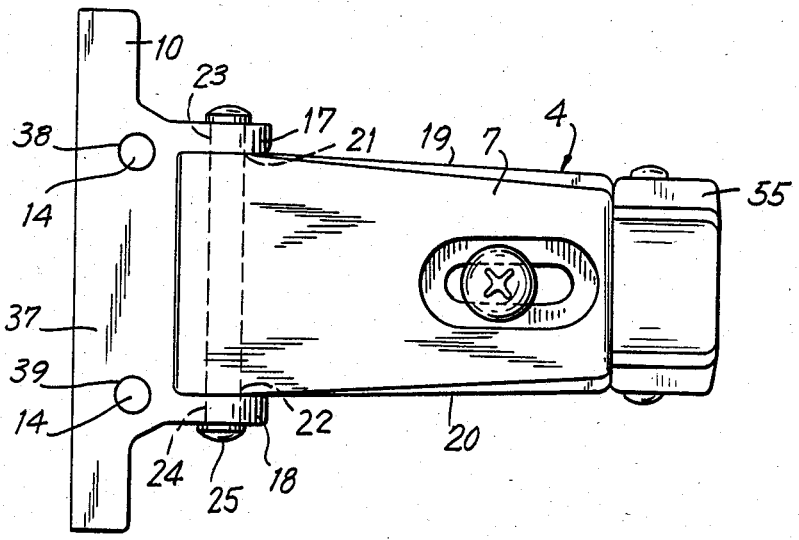
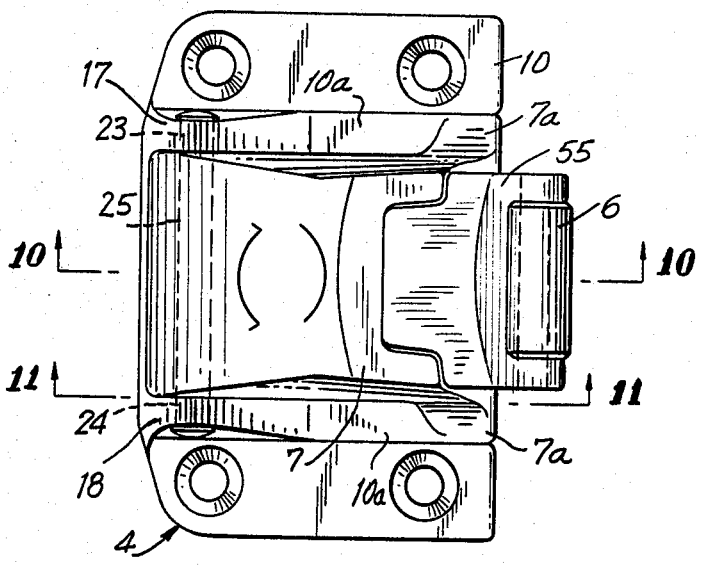
FIG. 6

FIG. 7
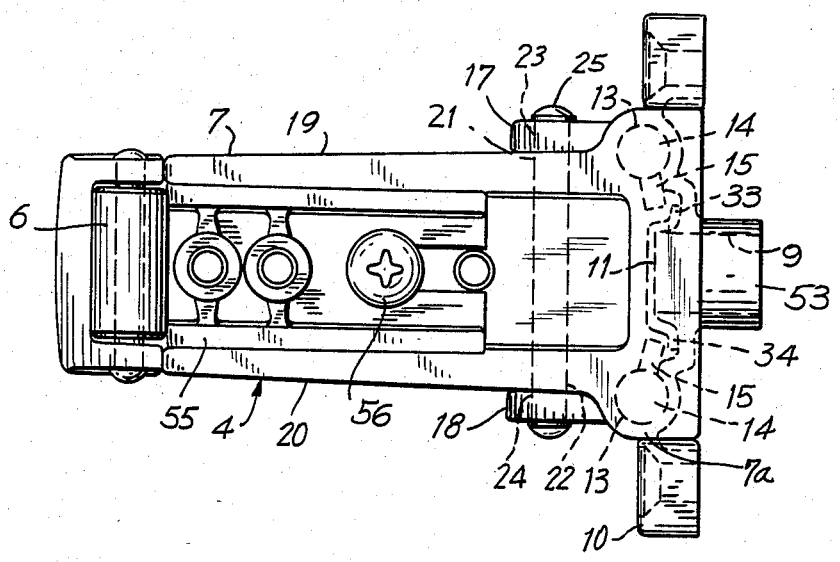
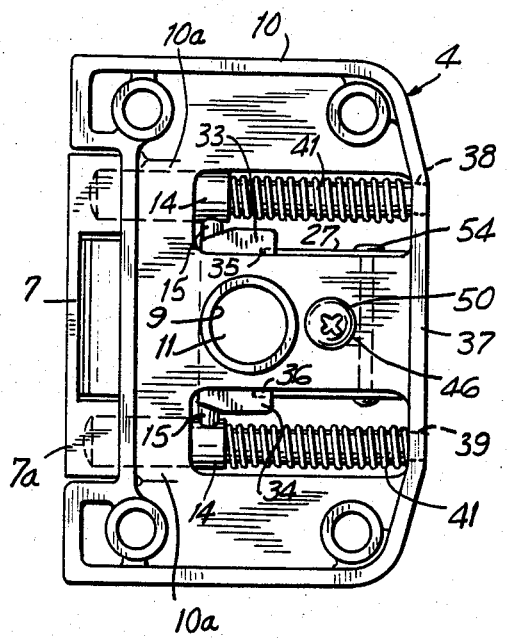
FIG. 8

FIG. 11
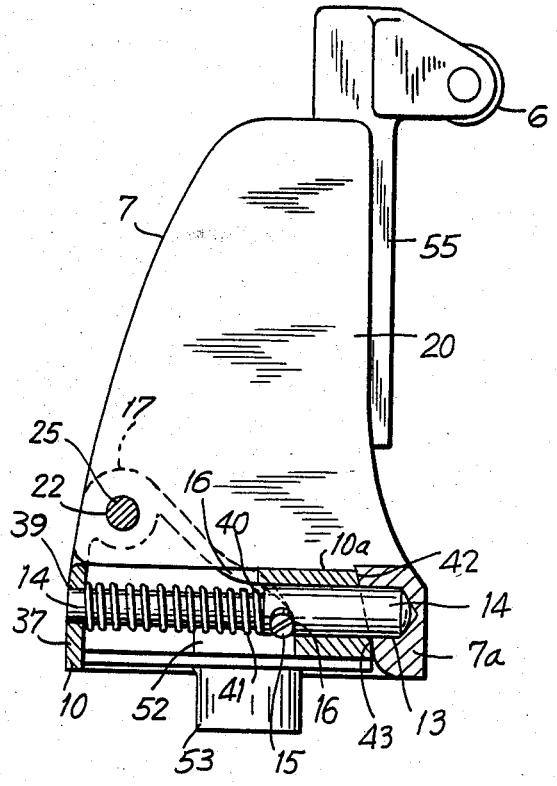
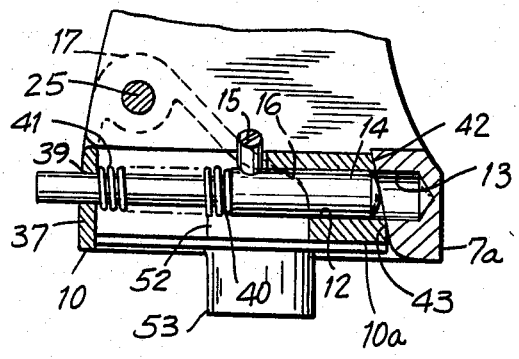
FIG. 12

LOCK FOR REFRIGERATOR OR THE LIKE WHICH CAN BE UNLOCKED FROM INSIDE THEREOF

BACKGROUND OF INVENTION

The present invention relates to a lock which locks the door of a walk-in type large-sized refrigerator, freezing chamber or the like to the body thereof, and more particularly relates to a lock which can be unlocked from the inside of the above-mentioned refrigerator or the like.

The walk-in type refrigerator or the like is necessary to be constructed on the grounds of safety, such that if while a person is working inside the refrigerator or the like the door thereof is closed and locked by a mistake in operation made by other person or an accidental action, the door can be unlocked and opened through an operation performed by the trapped person oneself.

The inventor of the present invention has already proposed a lock, wherein a keeper is constituted by a fixed seat secured to a frame wall of the refrigerator body and a keeper body pivotally attached to the fixed seat and wherein the keeper body is rotated through an operation of a push rod performed from the inside of the refrigerator, thereby to undo the engagement between a latch member of a handle unit mounted on the door and a keeper member mounted on the keeper body.

This lock, however, has a limitation on improvement in structual secureness properties, since the fixed seat and the keeper body are connected through a strip-like coupling member which is easily distorted or deformed when a large stress acts thereon.

In addition, the operation of the lock is troublesome, since it is necessary to effect the re-assembly of the fixed seat and the movable body while maintaining the coupling member and an interlocking mechanism connected thereto in a given position.

SUMMARY OF INVENTION

It is, therefore, a primary object of this invention to provide a lock for a refrigerator or like enclosure, in which the structure for coupling the fixed seat and the movable body of the keeper element is made secure, and the fixed seat and the movable body can be easily re-assembled by a single operation.

To this end, according to the invention, there is provided a lock for a refrigerator or like enclosure which can be unlocked from the inside thereof, the lock comprising: a handle unit mounted on a door; and a keeper mounted on a body frame wall of the refrigerator or the like, the keeper being constituted by: a fixed seat secured to the body frame wall and provided in its center with a guide hole for a push rod provided inside the refrigerator or the like; and a movable body having at its distal end a keeper member with which a latch member of the handle unit comes in and out of engagement and having its outer proximal end pivotally attached to the outer end of the fixed seat, the keeper further having: an actuating lever having its outer end pivotally attached to the outer end of the fixed seat; a lock shaft slidably and rotatably received by a bearing hole provided at the inner end of the fixed seat, the lock shaft being urged by a spring so as to be slidable inwardly; and a follower pin upstanding on an intermediate portion of the lock shaft, the follower pin having its proximal end abutting on an inclined cam surface formed on the outer end surface of the fixed seat inner end, wherein the actuating lever is rotated by pushing the push rod so that the follower pin is pushed by the inner end of the actuating lever to slide outwardly while rotating the lock shaft to permit the inner end of the lock shaft to escape from the bearing hole in the movable body, thereby allowing the movable body to be rotatable with respect to the fixed seat.

BRIEF DESCRIPTION OF DRAWINGS

The invention will be described hereinunder in detail through preferred embodiments thereof shown in the accompanying drawings. However, the invention is not limitative to these embodiments. In the drawings

FIG. 5 is a side view of the keeper as viewed from the left side thereof;

FIG. 6 is a front view of the keeper;

FIG. 7 is a side view of the keeper as viewed from the right side thereof;

FIG. 8 is a rear view of the keeper;

FIG. 11 is a sectional view taken along the line 11—11 of FIG. 6, in which an actuating lever and a support plate are not shown;

FIG. 12 is a sectional view of an essential part of the keeper, corresponding to FIG. 11, in the state where a lock shaft has slid outwardly;

DESCRIPTION OF INVENTION

Figure 1:
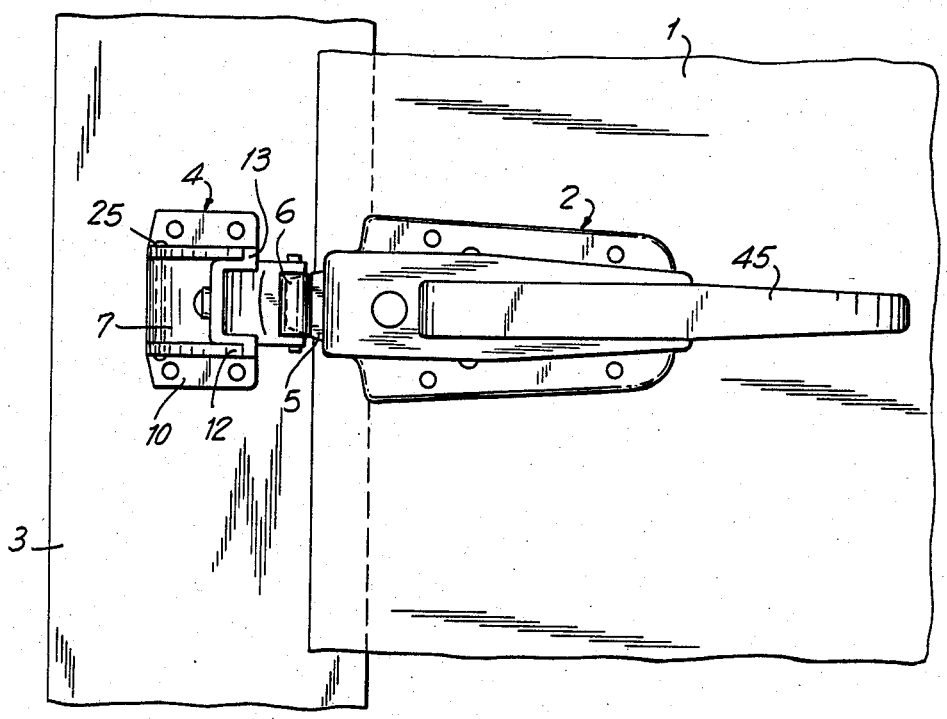
FIG. 1 is a front or plan view of an essential part of a refrigerator equipped with a lock in accordance with an embodiment of the invention.
Figure 2:
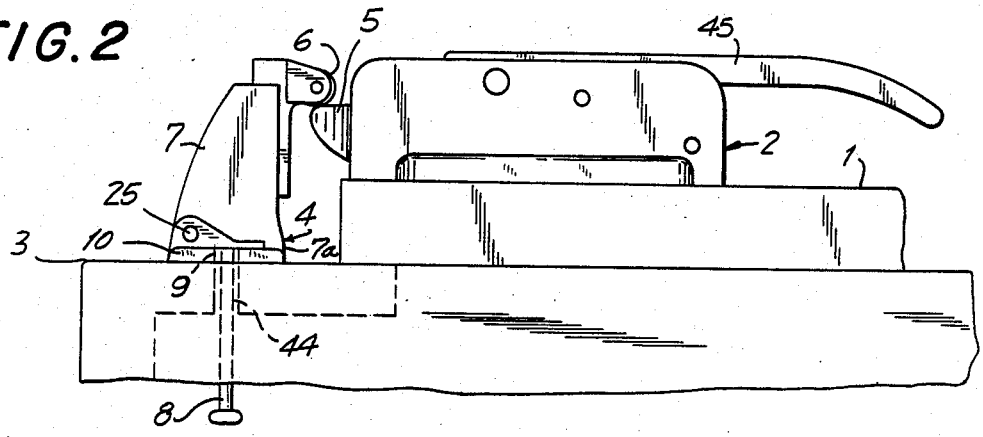
FIG. 2 is a bottom or elevation view of an essential part of the refrigerator equipped with the lock.
Figure 3:
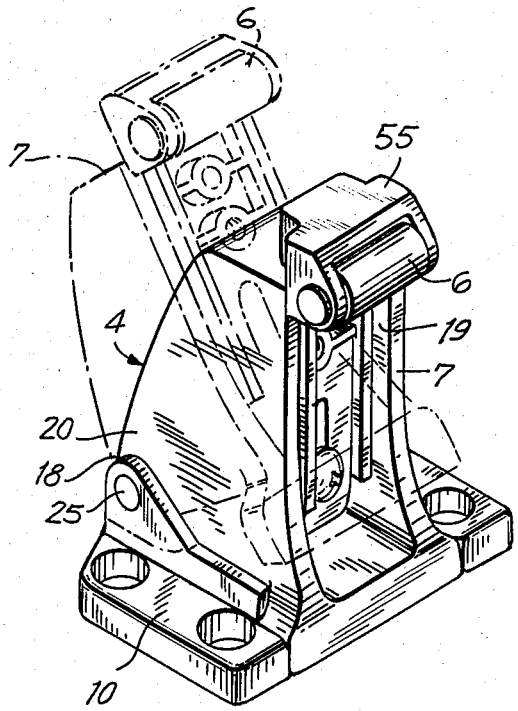
FIG. 3 is a perspective view of a keeper portion of the lock.

As shown in FIGS. 1 through 3, a lock in accordance with the invention comprises a handle unit 2 and a keeper 4. The handle unit 2 is secured to the front surface of a door 1 by proper fastening means, such as bolts or screws. A fixed seat 10 constituting the keeper 4 is secured to the front surface of a refrigerator body frame wall 3 by proper fastening means, such as bolts or screws. A movable body 7 constituting the keeper 4 has a height regulating plate 55 secured thereto by means of two screws 56. A roller-type keeper member 6 is mounted at the distal end of the height regulating plate 55. A latch member 5 provided on the handle unit 2 is adapted to engage the keeper member 6 when a handle 45 is positioned in parallel to the front surface of the door 1, thereby to lock the door 1 to the refrigerator body frame wall 3 so that the door 1 cannot be opened.

As shown in FIGS. 4–10, a pair of upper and lower bearing bosses 17, 18 are provided at the end of the fixed seat 10 on the side opposite to the door 1 with respect to a guide hole 9 for a push rod 8, i.e., the outer end of the fixed seat 10. The movable body 7 has through holes 21, 22 formed in the outer proximal ends of upper and lower side walls 19, 20 thereof, respectively. The movable body 7 is pivotally attached to the fixed seat 10 by means of a pivot rod 25 received by these through holes 21, 22 and through holes 23, 24 formed in the bearing boses 17, 18, respectively.

The fixed seat 10 is provided on its front and reverse sides with short cylindrical portions 52 and 53, respectively, surrounding the guide hole 9. A support plate 26 of a U-shaped cross-section has a semicircular notch 47 provided on its inner end side. The support plate 26 is made to abut on the front surface of the fixed seat 10 while allowing the notch 47 to engage the short cylindrical portion 52 and is secured to the fixed seat 10 by means of a screw screwed from a through hole 50 in the fixed seat 10 into a screw-receiving tubular portion 48 formed in the center of the support plate 26. The short cylindrical portion 53 on the reverse side of fixed seat 10 is fitted into a through hole 44 formed in the refrigerator body frame wall 3, when the fixed seat 10 is secured to the refrigerator body frame wall 3.

For support plate 26, through holes 29, 30 are provided in the outer ends of a pair of upright side walls 27, 28 of the support plate 26, respectively. In addition, through holes 31, 32 are provided in projections at the outer end of an actuating lever 11, respectively. The actuating lever 11 is pivotally attached to the support plate 26, that is, the outer end of the fixed seat 10 by means of a pivot pin 54 received by the through holes 29, 30, 31 and 32.

Figure 10:
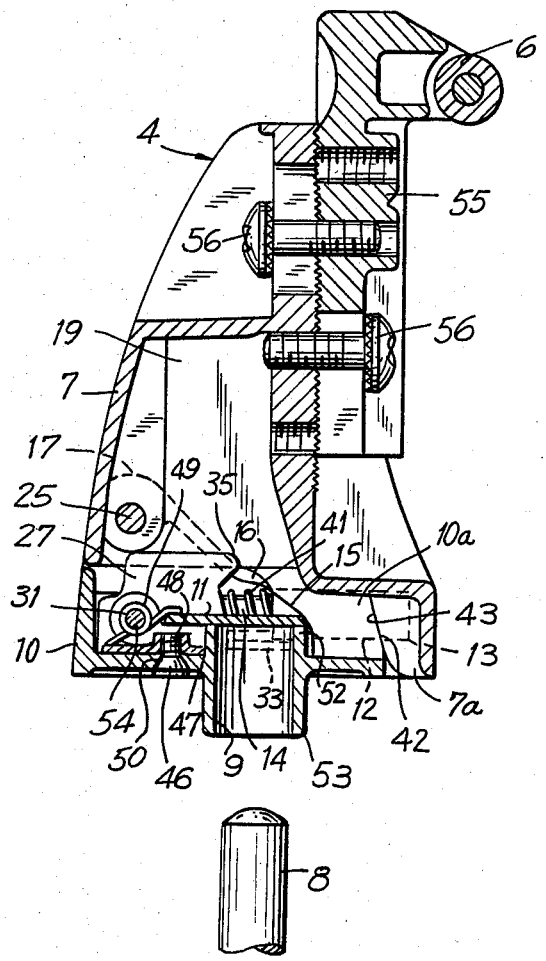
FIG. 10 is a sectional view taken along the line 10—10 of FIG. 6.
Figure 13:
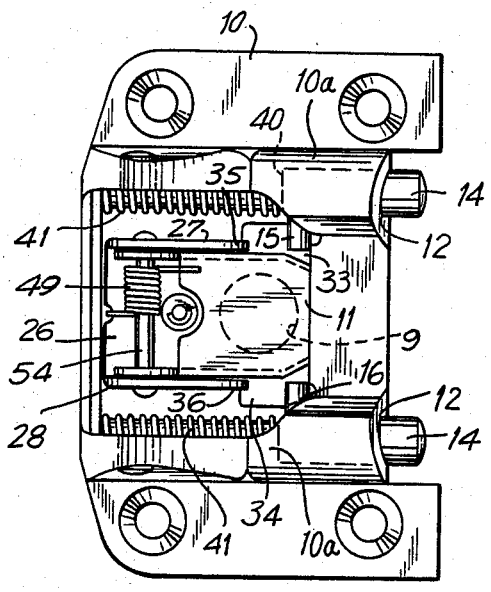
FIG. 13 is a front view of a fixed seat portion of the keeper.
Figure 14:
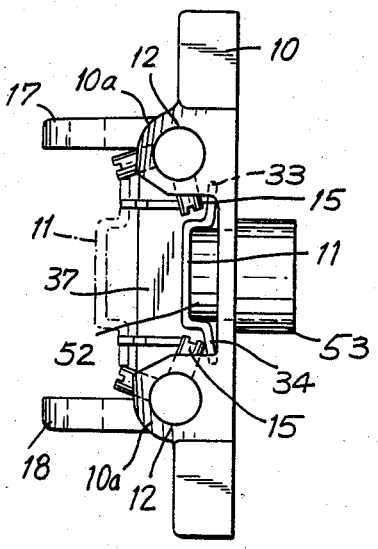
FIG. 14 is a side view of the fixed seat as viewed from the right side thereof.
Figure 15:
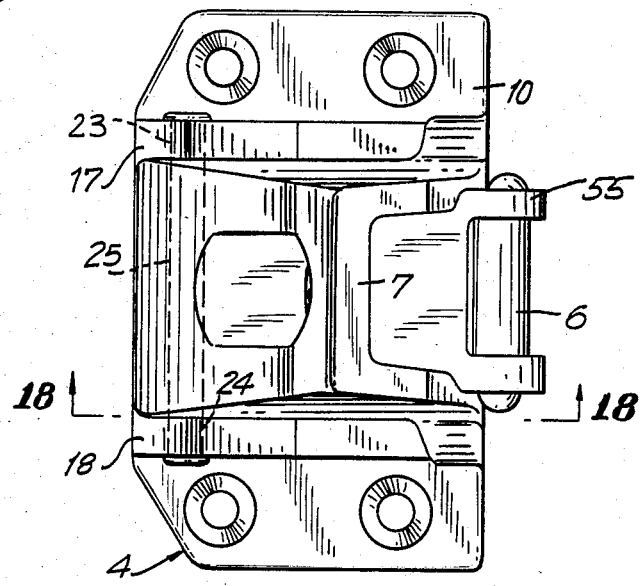
FIG. 15 is a front view of a lock in accordance with another embodiment of the invention.
Figure 16:
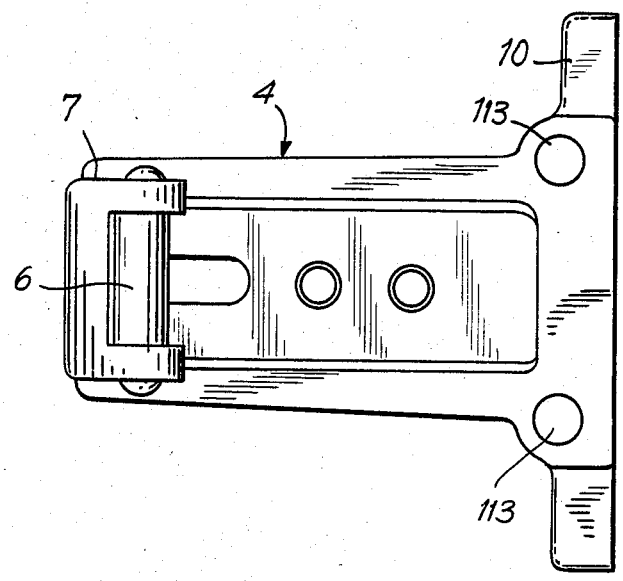
FIG. 16 is a side view of the lock shown in FIG. 15 as viewed from the right side thereof.
Figure 17:
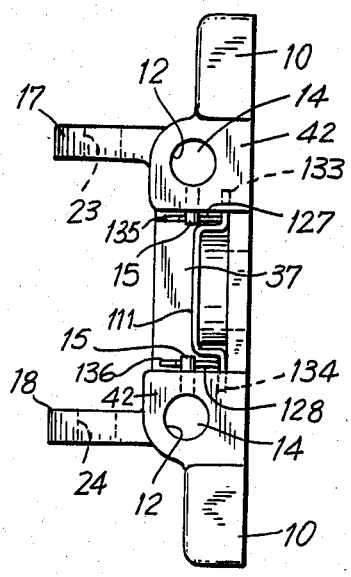
FIG. 17 is a side view of a fixed seat portion of the lock shown in FIG. 15 as viewed from the right side thereof.
Figure 18:
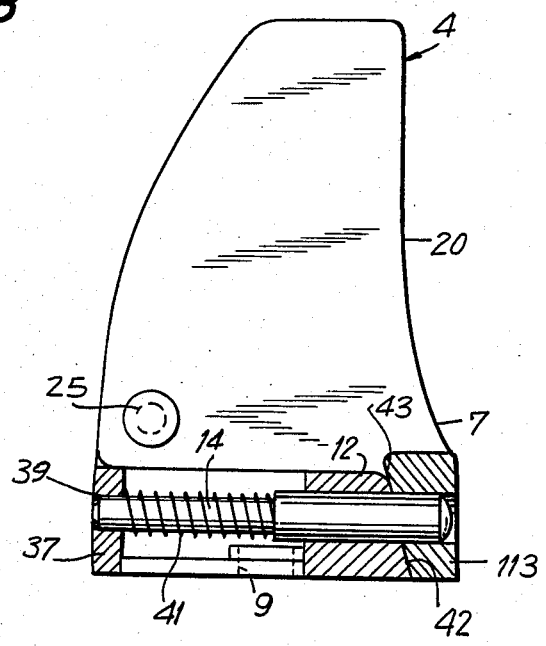
FIG. 18 is a sectional view taken along the line 18—18 of FIG. 15, in which an actuating lever and a support plate are not shown.
Figure 19:
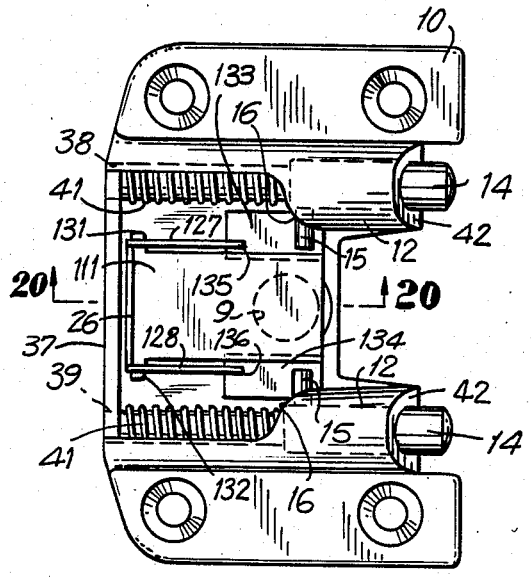
FIG. 19 is a front view of the fixed seat in the lock shown in FIG. 15.
Figure 20:
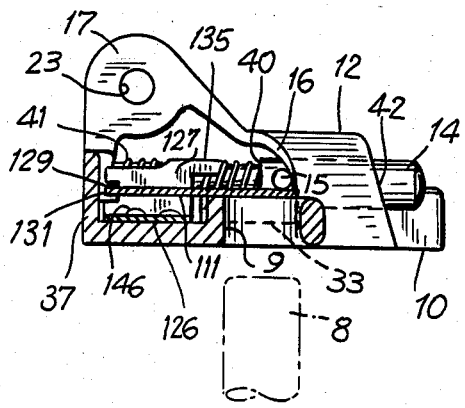
FIG. 20 is a sectional view taken along the line 20—20 of FIG. 19.
Figure 21:
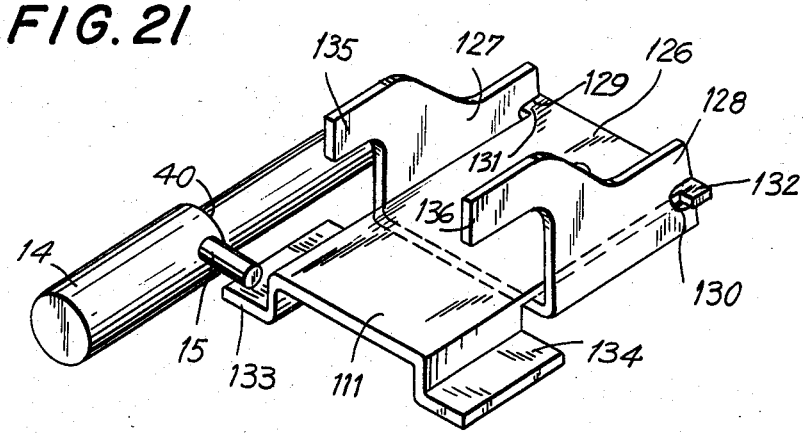
FIG. 21 is a perspective view showing the positional relationship among the actuating lever, support plate and lock shaft employed in the lock shown in FIG. 15.

As shown in FIGS. 10 and 13, one end of a coiled spring 49 fitted on the pivot pin 54 abuts on the support plate 26, while the other end of the spring 49 abuts on the actuating lever 11. In consequence, the actuating lever 11 is rotatably urged toward the front surface of the fixed seat 10 and therefore abuts on the short cylindrical portion 52. The rotatable urging effected by the coiled spring 49 ensures the returning motion of the actuating lever 11 when pressing on a push rod 8 provided inside the refrigerator is suspended.

Figure 4:
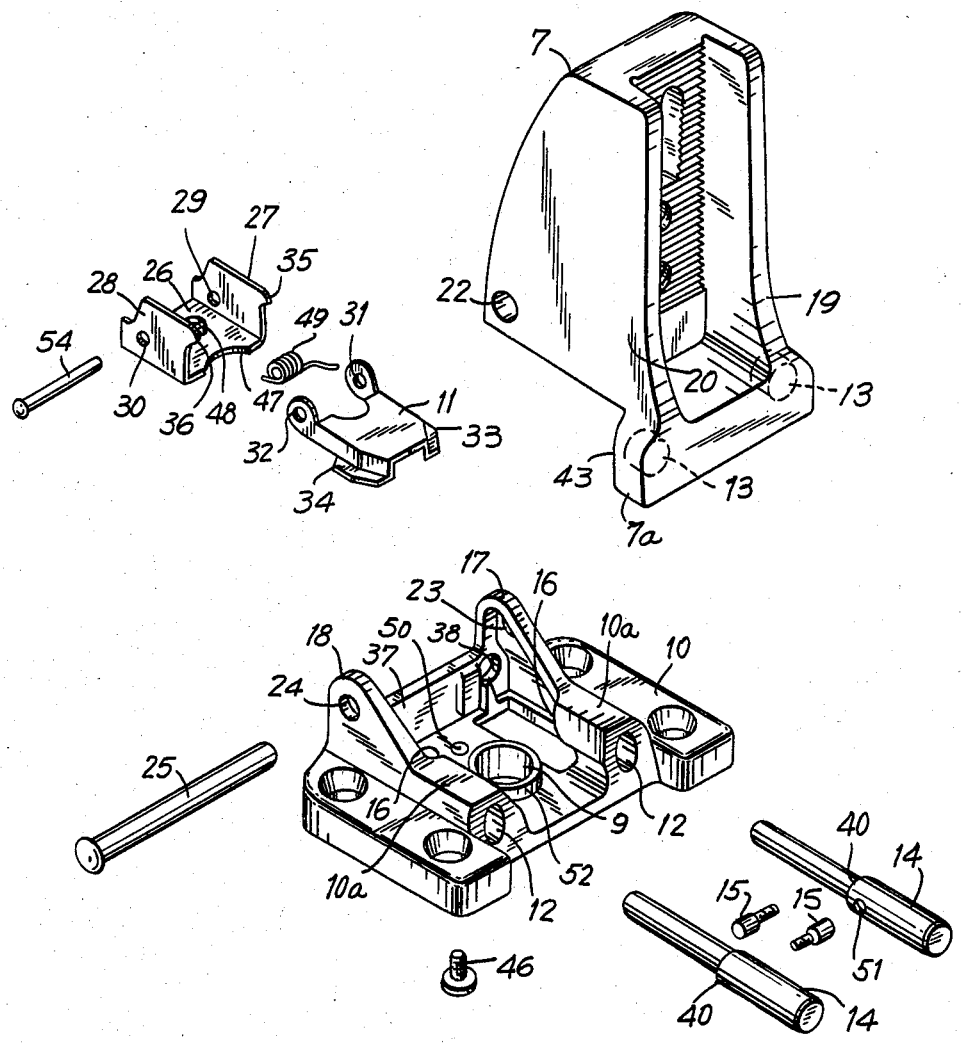
FIG. 4 is an exploded perspective view of the keeper.

As shown in FIGS. 4, 7 and 8, two upper and lower lock shafts 14 are employed to further intensify the coupled strength between the fixed seat 10 and the movable body 7. Each lock shaft 14 is provided in its intermediate portion with a screw hole 51 formed in the radial direction thereof. A follower pin 15 is screwed into each screw hole 51. Bearing holes 12 formed in the inner end 10*a* of the fixed seat 10 are through holes extending through the inner end 10*a*, while bearing holes 13 provided at the inner proximal end 7*a* of the movable body 7 are blind holes which are formed only in the outer end surface 43 of the inner proximal end 7*a*.

More specifically, since the bearing holes 13 are formed so as not to reach the inner end surface of the inner proximal end 7*a*, the inner end of the lock shaft 14 cannot be pressed from the inner end side to push the lock shaft 14 out from the bearing hole 13. For this reason, the coupled state between the fixed seat 10 and the movable body 7 by means of the lock shafts 14 is firmly maintained; therefore, it is possible to obtain an excellent reliability in locking.

An upright wall 37, formed between the bearing bosses 17, 18 of the fixed seat 10, is provided in its upper and lower ends thereof with guide holes 38, 39 for rotatably and slidably receiving the small-diameter outer ends of the lock shafts 14, respectively. As shown in FIGS. 8, 11 and 12, a compression coiled spring 41 is loaded between the upright wall 37 and an intermediate step surface 40 of the lock shaft 14 so that each lock shaft 14 is slidably urged by means of the spring 41 toward the fixed seat inner end 10*a*, i.e., toward the door 1.

The follower pin 15 provided at the lock shaft intermediate portion abuts on the inclined cam surface 16 of the fixed seat inner end 10*a* by the proximal end peripheral surface thereof. Since the inclined cam surface 16 is formed into a spiral with a central angle of 90 degrees, however, the follower pin 15 is slid along the inclined cam surface 16 by the slidable urging effected by the spring 41. As a result, when the follower pin 15 reaches its stable position shown in FIGS. 11 and 13, the lock shaft 14 has rotated 90 degrees from its retracting position shown in FIG. 12.

The distal end portion of the actuating lever 11 is formed in an inverted U shape in cross-section and has wings 33, 34 projecting to the upper and lower sides, respectively. When the actuating lever 11 is pushed with the push rod 8 inserted through the through hole 44 in the refrigerator body frame wall 3 and the guide hole 9 in the fixed seat central part, the actuating lever 11 rotates about the pivot pin 54 to push the follower pins 15 through the wings 33, 34. Thus, each lock shaft 14 outwardly slides along the bearing hole 12 while rotating 90 degrees in the reverse direction against the spring 41. In the final stage of the pivoting of the actuating lever 11, the inner end of each lock shaft 14 escapes from the bearing hole 13 in the movable body 7, thereby allowing the movable body 7 to be released from the restraint with respect to the fixed seat 10.

Figure 9:
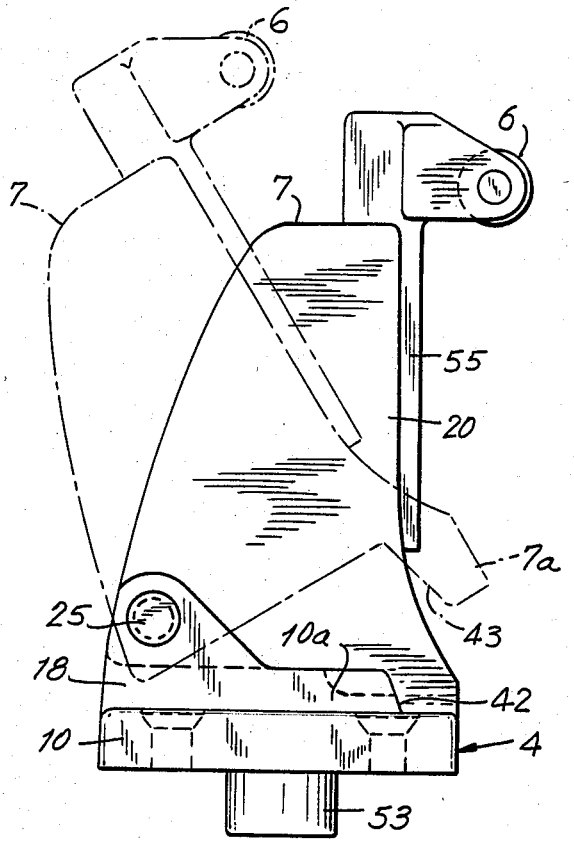
FIG. 9 is a bottom view of the keeper.

Under this state, further pressing the push rod 8 causes the movable body 7 to rotate outwardly about the pivot rod 25 as shown in FIGS. 3 and 9, so that the keeper member 6 on the movable body 7 disengages from the latch member 5 of the handle unit 2. Thus, the locking of the door 1 to the refrigerator frame wall 3 can be reliably undone from the inside of the refrigerator without the need for pulling the handle 45 of the handle unit 2 from the outside of the refrigerator to retract the latch member 5.

In this embodiment, the inner end and the wings 33, 34 of the actuating lever 11 are formed into a tapered shape as viewed from the front; therefore, the follower pins 15 can be smoothly and reliably driven by the actuating lever 11. In addition, since the projections 35, 36, on which the wings 33, 34 can abut, are provided at the inner distal ends of the upright walls 27, 28 of the support plate 26, the actuating lever 11 is prevented from any excessive rotation, so that the wings 33, 34 will never come off from the respective follower pins 15, 15.

In this embodiment, the outer end surface 43 of the inner proximal end 7*a* of the movable body 7 and the inner end surface 42 of the inner end 10*a* of the fixed seat 10 are formed into an inclined surface which is tangent to a circular arc centered at the pivot rod 25 at the outer end of the movable body 7, and moreover, the inner end of each lock shaft 14 is formed into a hemispheric shape. Therefore, when the movable body 7 and the fixed seat 10 are re-assembled, after the unlocking operation from the inside of the refrigerator, by reversely rotating the movable body 7 about the pivot rod 25, the lock shafts 14 are smoothly pushed in, without any obstacle, by the outer end surface 43 of the inner proximal end 7*a* of the movable body 7.

The lock shafts 14 pushed by the outer end surface 43 of the inner proximal end 7*a* of the movable body 7 outwardly slide against the urging forces applied by the springs 41 and while being rotated by the guiding actions of the inclined cam surfaces 16 and the follower pins 15, respectively. When the outer end surface 43 of the inner proximal end 7*a* of the movable body 7 and the inner end surface 42 of the inner end 10 of the fixed seat 10 abut on each other, the bearing holes 12 and 13 communicate with each other. In consequence, the lock shafts 14 inwardly slide while reversely rotating, and the inner ends enters the respective bearing holes 13 formed in the movable body 7. Thus, the movable body 7 is locked against rotation with respect to the fixed seat 10, to reach the completion of re-assembly. Each follower pin 15 abutting on the inclined cam surface 16 also serves as a stopper which regulates the amount of projection of the lock shaft 14 from the inner end surface 42 of the fixed seat inner end 10*a*.

Another embodiment of the invention shown in FIGS. 15 to 21 has a structure and operation which are basically similar to those of the above-described embodiment. In this other embodiment, however, a support plate 126, which is secured by means of a screw 146 from the front side of the fixed seat 10, has notches 129, 130 provided in the outer ends of upright side walls 127, 128, respectively. These notches 129, 130 are loosely fitted with projecting members 131, 132 provided on the outer end of an actuating lever 111, respectively, so that when the actuating lever 111 is pushed with the push rod 8, similarly to the above-mentioned actuating lever 11, the actuating lever 111 rotates about the notches 129, 130. Both wings 133, 134 of the actuating lever 111 are formed so as to be parallel to projections 135, 136 at the inner ends of the upright walls 127, 128, respectively.

In this embodiment, bearing holes 113 provided at the inner proximal end 7*a* of the movable body 7 are formed as through holes similar to the bearing holes 12 at the fixed seat inner end 10*a* to meet the convenience of fabrication. For the prevention of any push-back operation of the lock shafts 14 from the inside of the movable body 7, it is only necessary to close the inner openings of the bearing holes 113 with a metal plate or the like.

As has been described above, the lock in accordance with the invention employs the lock shafts 14 as means for coupling the movable body 7 of the keeper 4 to the fixed seat 10 so that the movable body 7 cannot rotate, and each lock shaft 14 is received by the bearing holes 12, 13 provided at the inner end 10*a* of the fixed seat 10 and the inner proximal end 7*a* of the movable body 7, respectively. Therefore, the coupled structure between the fixed seat 10 and the movable body 7 of the keeper 4 is constructed to be much more secure than the conventional strip member, so that durability of the lock is improved.

In addition, when the movable body 7 is pivoted toward the fixed seat 10, the outer end surface 43 of the movable body inner proximal end 7*a* abuts on the inner ends of the lock shafts 14 projecting from the inner end surface 42 of the fixed seat inner end 10*a*, causing the lock shafts 14 to slide so as to withdraw into the respective bearing holes 12 formed in the fixed seat 10. In the final stage where the movable body 7 has rotated to its normal position, the inner ends of the lock shafts 14 are automatically slid into the bearing holes 13 formed in the movable body 7 by the urging forces of the springs 41, respectively, thereby allowing the movable body 7 to be coupled to the fixed seat 10 again. Thus, in the lock of the invention, the re-assembly of the fixed seat 10 and the movable body 7 of the keeper 4 can be completed only by such a single operation as the pivoting of the movable body 7. Accordingly, the lock in accordance with the invention is easy to operate, advantageously.

What is claimed is:

1. A lock for a refrigerator or the like which can be unlocked from the inside thereof, said lock comprising:

a handle unit mounted on a door; and a keeper mounted on a body frame wall of the refrigerator or the like, said keeper being constituted by: a fixed seat secured to said body frame wall and provided in its center with a guide hole for a push rod provided inside the refrigerator or the like; and a movable body having at its distal end a keeper member with which a latch member of said handle unit comes in and out of engagement and having its outer proximal end pivotally attached to the outer end of said fixed seat, said keeper further having: an actuating lever having its outer end pivotally attached to the outer end of said fixed seat; a lock shaft slidably and rotatably received by a bearing hole provided at the inner end of said fixed seat and a bearing hole provided at the inner proximal end of said movable body; a spring slidably urging said lock shaft toward the fixed seat inner end so that the inner end of said lock shaft engages said bearing hole in said movable body; and a follower pin upstanding on an intermediate portion of said lock shaft, said follower pin having its proximal end abutting on an inclined cam surface formed on the outer end surface of said fixed seat inner end, wherein said actuating lever is rotated by pushing said push rod so that said follower pin is pushed by the inner end of said actuating lever to cause said lock shaft to slide outwardly while rotating, thereby allowing the lock shaft inner end to escape from the bearing hole in said movable body.

2. The lock according to claim 1, wherein the bearing hole in said movable body is formed into a blind hole which is not opened to the inner end surface of said movable body inner proximal end.

3. The lock according to claim 1, wherein the inclined cam surface at said fixed seat inner end is formed into a spiral with a central angle of 90 degrees.

4. The lock according to claim 1, wherein the outer end surface of said movable body inner proximal end and the inner end surface of said fixed seat inner end are formed into an inclined surface which is inclined tangentially to a circular arc centered at a pivot at the outer end of said movable body.

5. The lock according to claim 1, wherein said actuating lever is pivotally urged by means of a spring toward the front surface of said fixed seat.

6. The lock according to claim 1, wherein the inner end of said actuating lever is formed into a tapered shape.

* * * * *